US007238096B2

(12) United States Patent
Scott

(10) Patent No.: US 7,238,096 B2
(45) Date of Patent: Jul. 3, 2007

(54) ORBITAL ROTARY BLADE SHARPENER

(75) Inventor: William S. Scott, Vancouver, WA (US)

(73) Assignee: AFAB Innovations, Inc., Vancouver, WA (US)

( * ) Notice: Subject to any disclaimer, the term of this patent is extended or adjusted under 35 U.S.C. 154(b) by 0 days.

(21) Appl. No.: 11/437,398

(22) Filed: May 19, 2006

(65) Prior Publication Data

US 2007/0054604 A1 Mar. 8, 2007

Related U.S. Application Data

(60) Provisional application No. 60/714,409, filed on Sep. 6, 2005.

(51) Int. Cl.

| | |
|---|---|
| ***B24B 1/00*** | (2006.01) |
| ***B24B 7/19*** | (2006.01) |
| ***B24B 7/30*** | (2006.01) |
| ***B24B 19/00*** | (2006.01) |
| ***B24B 23/00*** | (2006.01) |
| ***B24B 27/08*** | (2006.01) |
| ***B24B 7/00*** | (2006.01) |

(52) U.S. Cl. ..... 451/349; 451/45; 451/371; 451/357; 451/358; 451/359; 451/549; 451/282; 451/367

(58) Field of Classification Search ..... 451/44, 451/45, 349, 357–359, 420–423, 545, 549, 451/557, 558, 241, 254, 258, 282, 367, 369–371; 30/138, 139; 83/174.1

See application file for complete search history.

(56) References Cited

U.S. PATENT DOCUMENTS

| | | | | |
|---|---|---|---|---|
| 889,830 A | | 6/1908 | Van Berkel | |
| 1,051,646 A | | 1/1913 | Stukart | |
| 1,165,342 A | | 12/1915 | Peterson | |
| 1,310,700 A | | 7/1919 | Hood et al. | |
| 1,957,776 A | | 5/1934 | Gury | |
| 1,977,418 A | | 10/1934 | Winkler | |
| 2,694,887 A | | 11/1954 | Green et al. | |
| 2,721,430 A | | 10/1955 | Green et al. | |
| 3,349,485 A | | 10/1967 | Bettcher | |
| 4,306,385 A | * | 12/1981 | Burton | 451/421 |
| 4,373,302 A | | 2/1983 | Darby | |
| 5,499,943 A | * | 3/1996 | Terris | 451/549 |
| 5,660,582 A | * | 8/1997 | Terris | 451/359 |

* cited by examiner

*Primary Examiner*—Joseph J. Hail, III
*Assistant Examiner*—Bryan Muller
(74) *Attorney, Agent, or Firm*—Kurt M. Rylander; Rylander & Assoc. PC

(57) ABSTRACT

An orbital rotary blade sharpener for sharpening rotary cutter blades and other rotary blades includes a bottom blade holding portion having a center and a perimeter edge, a top blade holding portion rotatably connectable to said bottom blade holding portion, having a perimeter and a center, a central shaft portion extending from said bottom blade holding portion through said top blade holding portion over which a rotary blade can be fitted, a radial shaft portion extending through said top blade holding portion positioned between the perimeter and the center of the top blade holding portion, and grinding portion connected to said radial shaft portion, and within said top blade holding portion, positioned to be orbitally revolvable around said bottom blade holding portion center and contactable with a blade held between said top and bottom blade holding portions.

13 Claims, 12 Drawing Sheets

ORBITAL ROTARY BLADE SHARPENER

CROSS-REFERENCE TO RELATED APPLICATION

This claims priority to co-pending Provisional Application Ser. No. 60/714,409, filed Sep. 6, 2005.

FIELD OF THE INVENTION

The present invention relates to blade sharpeners. More particularly, the present invention relates to devices and methods for sharpening rotary cutting blades.

BACKGROUND

Rotary cutting blades are used for cutting fabric in quilt making, among other uses. Rotary cutting blades typically come in two standard sizes, the 45 mm diameter rotary cutting blade and the 60 mm diameter rotary cutting blade. An existing problem in the use of rotary cutting blades is the current high replacement cost of the blades for this popular fabric, craft and hobby cutting tool. Moreover, typical rotary cutting blades lack perfect roundness, wavering in radius as much as 2 mm out of perfect roundness. Existing products induce warping into the rotary cutter blade and therefore only sharpened quadrants of the blade's circumference. In addition, the abrasive strips intended to sharpen the cutting edge of the blade were actually falling off in the package because the adhesive had failed and this was before it was taken out of the package and used. In use, the blade cutting edge contact surface of the abrasive strip, to not be very robust and a groove quickly wore into it removing the abrasive particles thus creating a very short product life.

Existing products include large commercial circular blade sharpeners for meat slicing and the like. Also included were motorized commercial motor driven fabric cutters of various descriptions, and only the one manual sharpener for hand held rotary cutters mentioned herein.

The following represents a list of known related art:

| Reference: | Issued to: | Date of Issue: |
|---|---|---|
| U.S. Pat. No. 5,660,582 | Terris | Aug. 26, 1997 |
| U.S. Pat. No. 5,499,943 | Terris | Mar. 19, 1996 |
| U.S. Pat. No. 889,830 | Van Berkel | Jun. 2, 1908 |
| U.S. Pat. No. 1,051,646 | Stukart | Jan. 28, 1913 |
| U.S. Pat. No. 1,165,342 | Peterson | Dec. 21, 1915 |
| U.S. Pat. No. 1,957,776 | Gury | May 8, 1934 |
| U.S. Pat. No. 1,310,700 | Hood et al. | Jul. 22, 1919 |
| U.S. Pat. No. 1,977,418 | Winkler | Oct. 16, 1934 |
| U.S. Pat. No. 2,694,887 | Green et al. | Nov. 23, 1954 |
| U.S. Pat. No. 2,721,430 | Green et al. | Oct. 25, 1955 |
| U.S. Pat. No. 3,349,485 | Betcher | Oct. 31, 1967 |
| U.S. Pat. No. 4,373,302 | Darby | Feb. 15, 1983 |

The teachings of each of the above-listed citations (which does not itself incorporate essential material by reference) are herein incorporated by reference. None of the above inventions and patents, taken either singularly or in combination, is seen to describe the instant invention as claimed.

Existing art has a number of disadvantages, including the inability to adjust to accept rotary cutter blades of various small sizes for use in hand held rotary cutter tools. In addition, other prior art reviewed, does not maintain a precision alignment and support between the rotary cutter blade and the abrasive element, and in its current configuration, is incapable of creating a razor sharp edge consistently around the total circumference of a rotary cutter blade's cutting peripheral edge.

U.S. Pat. No. 5,499,943 discloses a rotary cutter blade sharpener where the rotary cutter blade is sandwiched between two clamping elements, which if they are not precisely flat and co-plainer could induce an out of flat condition onto a thin (approx. 0.020 thick rotary cutter blade) and create a shape not unlike a potato chip having high and low edges on the same side of the blade's peripheral circumference, making it impossible to sharpen with a rigid, angled, abrasive surface as shown. The isometric view (FIG. 4) is showing this prior art's radial, tapered, conical surface, having an abrasive strip affixed to it for the purpose of sharpening the rotary blade cutting edge, with no provision for replacement of this abrasive strip except by the purchase of a new device. Continued use of this device and its abrasive strip will shortly abrade it into an uneven, ringed, shape unable to support the sharpening process of the rotary blade's cutting edge. The rotary blade wears down through the abrasive material and it's adhesive backing, leaving no abrasive material available to sharpen the rotary blade's cutting edge, thus leaving the blade dull. In addition, my tests have concluded that the use of abrasive material such as claimed in this prior art, will breakdown very quickly after repeated use on the same contact point. Thus preventing the creation of a clean, sharp, burr free cutting edge on the rotary blade's cutting edge along with a very short usable product life span.

U.S. Pat. No. 5,660,582 discloses a radial, tapered, conical surface, having an abrasive strip affixed to it for the purpose of sharpening a rotary blade cutting edge, with no provision for replacement of the abrasive strip except by the purchase of a new device. Consistent and frequent sharpening of rotary blades of the same diameter, contacting this abrasive strip will create a groove at the point of contact with the rotary blade's cutting edge, and create a deformed area which will in turn create this same deformed shape onto the cutting edge of subsequent blades as they are rubbed in this distorted groove in the abrasive strip. Thus, creating a rounded, distorted, dull cutting edge, rather than maintaining the factory created cutting angle, shape, and sharp edge as with the present art. Additionally, the razor sharp edges are totally exposed to the operator while it is clamped into a blade handling device (FIGS. 6, 7, and 16). The risk is, if the clamped blade is dropped during use, that not only will the unprotected blade be possibly bent or chipped, and further dulled beyond repair. But it could cut the users shoe, bare foot, and expensive hardwood, tiled or carpeted floor. In use, user fingers can be cut on the rotary blade edge while trying to sharpen a blade per the user instructions included with the device. Also, it will be noted that the design and intended use of this prior art is as a hand held devise only, it can not be operated or used on a stable tabletop or work bench as with the present art. Also the clamping elements are shown with the surfaces for clamping the rotary cutter blade whereby the blade is sandwiched between these two clamping elements, which if they are not precisely flat and co-plainer could induce an out of flat condition onto a thin (approx. 0.020 thick rotary cutter blade) and create a shape not unlike a potato chip having high and low edges on the same side of the blade's peripheral circumference, making it impossible to sharpen with a rigid, angled, abrasive surface as shown. If the molding process and selected plastic materials are unable to produce a flat molded surface then it will not have the ability to clamp the rotary blade flat between them, which is the case with this prior art. The abrasive element shown is one of the critical components to the design of this prior art and its success as a viable and useful product. However, this prior art's radial, tapered, conical surface, having an abrasive strip affixed to it for the purpose of sharpening the rotary blade cutting edge, with no provision for replacement of this abrasive strip except by the purchase of a new device reduces its useful life and value to the customer. Continued use of this device and its abrasive strip will shortly abrade it into an uneven, ringed, shape unable to support the sharpening process of the rotary blade's cutting edge. The rotary blade wears down through the abrasive material and it's adhesive backing, leaving no abrasive material available to sharpen the rotary blade's cutting edge, thus leaving the blade dull. In addition, my tests have concluded that the use of abrasive material such as claimed in this prior art, will breakdown very quickly after repeated use on the same contact point. Thus preventing the creation of a clean, sharp, burr free cutting edge on the rotary blade's cutting edge along with a very short usable product life span.

Existing art has a number of other drawbacks, including the limited ability of these devices to adjust to accept rotary cutter blades of various smaller sizes for use in hand held rotary cutter tools. In addition, the need for a stationary, non-rotating, rotary cutter blade sharpener with a safety guard covering the blade and an abrasive element that is replaceable and capable of maintaining a precision alignment and support between the rotary cutter blade and the abrasive element, thus creating a razor sharp edge consistently around the total circumference of a rotary blade's cutting edge periphery, whereby the abrasive element is manually moved upon or around the stationary rotary blades cutting edge periphery to sharpen it. Reviewing prior art with these requirements in mind U.S. Pat. No. 889,830 shows a device that is very complicated, and designed for large meat slicing machines whereby the large rotary blade is rotated against a sharpening element located in a fixed position and having no safety shield.

U.S. Pat. No. 1,051,646 is a sharpening device that rotates the large rotary cutter blade used in meat slicing, and sharpens the blade using two stationary held abrasive elements. The device is not adjustable for small rotary cutter blades and does not have a safety guard as an integral part of its design.

U.S. Pat. No. 1,165,342 is a sharpener for rotary blades that is not adjustable for small rotary cutter blades and has no safety shield while it rotates the large rotary cutter blade for sharpening as it holds the abrasive elements in a fixed position.

U.S. Pat. No. 1,957,776 discloses a cloth cutting electric powered rotary cutter that is intended for use as an attachment to an electric cloth cutting machine and in this application again rotates the rotary blade against a stationary mounted abrasive element and is not adjustable for various size manual rotary cutter blades, although it does have a blade guard.

U.S. Pat. No. 1,310,700 discloses a sharpener for slicing machine knives is shown and in this case the rotary blade is rotated to sharpen it as well, while the single wheel abrasive device is held in a stationary position. This device is also not intended for the smaller type rotary cutter blades and has no safety guard.

U.S. Pat. No. 1,977,418 discloses a knife sharpener device of a complicated nature that is intended for attachment to an existing cutting machine of some design and application. The device uses one abrasive element and one burr removing element that are affixed in a stationary location while the rotary blade is rotated in contact with these two elements to facilitate the blades sharpening. The nature of this prior art design dose not lend its self to the sharpening of the smaller type rotary cutter blades.

U.S. Pat. No. 2,694,887 discloses a deburring device for the sharpening of a rotary-slicing blade. It is also a device intended to be added onto an existing slicing machine or included in its design. In operation, the rotary blade is rotated while the deburring element is held stationary in order to facilitate the removal of burrs during the sharpening of a rotary blade.

U.S. Pat. No. 2,721,430 discloses a sharpener device for slicing blades that relates to an attachment to be adapted to a machine that uses a large size rotary cutting blade, in order to make easy the sharpening of the blade thereof. Again, the abrasive element is held stationary and the rotary cutter blade is rotated as it is in contact with said abrasive element, thus abrading the blade and sharpening it.

U.S. Pat. No. 3,349,485 discloses a combination of a rotary knife with sharpener wherein the described band type blade of the hand held rotary knife cutter has an included fixed position blade sharpening element which comes in contact with the blade while it is being rotated to sharpen said band type blade. The sharpening element however is not easily removable to change to different grits or for its replacement. This prior art design dose not lend its self to the sharpening of the smaller, disc type, rotary cutter blades.

U.S. Pat. No. 4,373,302 discloses a sharpening apparatus for circular blades, This is a commercial bench mounted device for large diameter circular blades and can not be adjusted for smaller diameter rotary cutter blades for hand held devices. The rotary blades are rotated against a stationary positioned power driven sharpening element for sharpening of the cutting edge. This design is not intended for being adapted to a hand held device as with the present art.

In summary, the reviewed prior art commented on herein, employs designs and materials that limit there application to devices for large diameter rotary blades that are table mounted and not adaptable for hand use on smaller size hand held rotary cutter knife blade sharpening. In some cases, because of design and material selection, the device's performance and operation is marginal at best and in some cases shortens the useful product life. In other cases the materials available at the time or selected, along with the manufacturing methods chosen, were not a good match for the device, or the design was limited by the knowledge and experience of the inventor. The wrong materials for the application, over complexity, weakness or flexibility of components, or poor choice of mechanical design for the desired application can make a product undesirable for manufacturing because of cost, design appearance, and esthetics. The application of state of the art materials, engineering methods and improved manufacturing methods as applied to the present invention, and described herein will overcome the failings of the reviewed prior art, to create an improved design of a device and methods of manufacture for an orbital, multi-size, rotary cutter blade sharpener having changeable, multi-grit, diamond coated abrasive elements as described herein.

SUMMARY AND ADVANTAGES

An orbital rotary blade sharpener for sharpening rotary cutter blades and other rotary blades includes a bottom blade holding portion having a center and a perimeter edge, a top blade holding portion rotatably connectable to said bottom blade holding portion, having a perimeter and a center, a central shaft portion extending from said bottom blade holding portion through said top blade holding portion over which a rotary blade can be fitted, a radial shaft portion extending through said top blade holding portion positioned between the perimeter and the center of the top blade holding portion, and grinding portion connected to said radial shaft portion, and within said top blade holding portion, positioned to be orbitally revolvable around said bottom blade holding portion center and contactable with a blade held between said top and bottom blade holding portions.

The orbital rotary blade sharpener of the present invention presents numerous advantages, including: (1) provides a tabletop or hand held devices used in the sharpening of circular rotary cutter blades or the like needing a razor sharp radial cutting edge; (2) provides a simple, elegant and mechanically effective solution to rotary cutter blade sharpening; (3) addresses the problem of the warped rotary cutter blade shape; (4) holds the rotary cutter blade or the like, in a stationary position for receiving the sharpening process on its peripheral cutting edge; (5) rotates in an orbital rotation, at a distance to match the diameter of the rotary cutter blade's peripheral cutting edge, and about the center axis of the orbital sharpener's center shaft; (6) the combination of orbital rotation, and unrestricted up and down, vertical floatation movement, of the angle faced, diamond coated abrasive sharpening element, allows for 360 degrees of constant contact with the stationary, rotary cutter blade cutting edge, while automatically adjusting to any warping or irregularities in the clamping or cutting edge surface shape of the stationary rotary cutting blade; (7) provides the ability to easily replace its abrasive elements as they wear out thereby extending the life of the device; (8) provides the ability to sharpen more than one size of rotary cutter blades, thus increasing the flexibility of its use and economical value to the user customer; (9) increased safety of use, by providing a circular rotary cutter blade sharpening tool that will not exposes the operator of the present invention to a razor sharp cutting edge at any time during the sharpening of their rotary cutter blades while using this device; (10) provides ease of use by persons of age, or having medical problems, such as arthritic joints, or other problems restricting their manual gripping and twisting dexterity have been considered in the development and design of this present invention in an attempt to make it simple and ergonomically user friendly for all who love their quilting and sewing, crafts and other hobbies, that may require the use of rotary cutters, and the sharpening of their blades; (11) provides repeatable performance in the sharpening of rotary cutting blades, by using state of the art engineering design and manufacturing methods used herein; (12) provides a method for removing burrs created when removing nicks while using the course abrasive elements; (13) uniquely holds the abrasive element stationary and rotating the rotary blade to be sharpened which leaves burrs on the blades cutting edge; (14) uniquely uses an orbital, floating abrasive element to follow the blade cutting edge contour thus sharpening a full 360 degrees of the blade periphery on both sides eliminating the problem of leaving unsharpened areas on the blades cutting edge; (15) reduces the need for additional tools as required with some of the prior art has also been achieved; and (16) provide a device or apparatus for the sharpening of a circular cutting blade of a rotary cutting tool which is simple in design and easy and economical to manufacture, to name a few of the advantages.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

As shown in FIGS. 1-9, an orbital rotary blade sharpener 10 is provided for sharpening rotary cutter blades and similar rotary blades. An orbital rotary blade sharpener 10 includes a bottom blade holding portion having a center and a perimeter edge, a top blade holding portion rotatably connectable to said bottom blade holding portion, having a perimeter and a center, a central shaft portion extending from said bottom blade holding portion through said top blade holding portion over which a rotary blade can be fitted, a radial shaft portion extending through said top blade holding portion positioned between the perimeter and the center of the top blade holding portion, and grinding portion connected to said radial shaft portion, and within said top blade holding portion, positioned to be orbitally revolvable around said bottom blade holding portion center and contactable with a blade held between said top and bottom blade holding portions.

Figure 2:
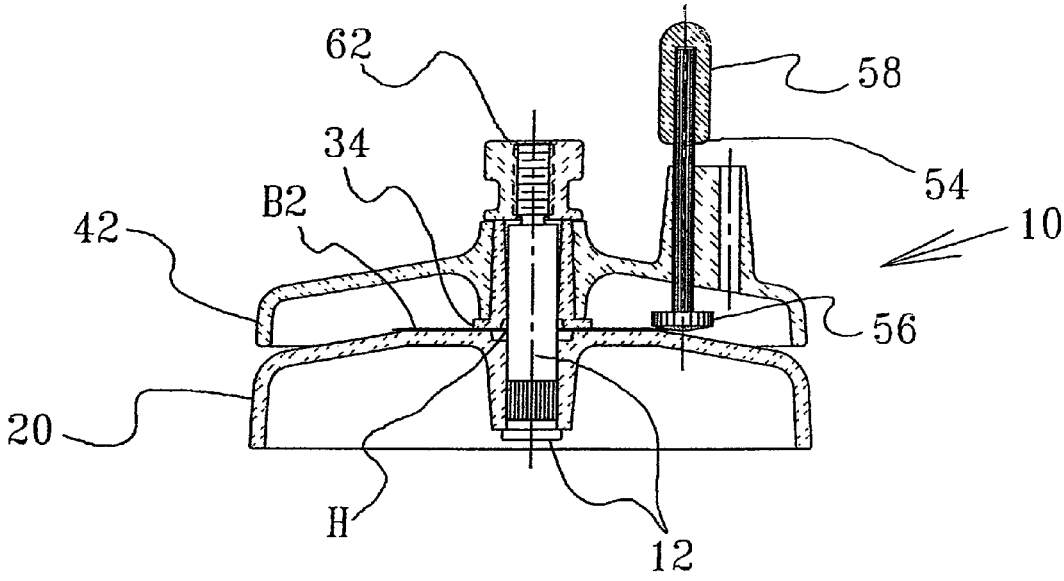
FIG. 2 shows a side view showing the device assembly components in cross section with the 45 mm rotary cutter blade installed and the diamond coated abrasive element in contact with the blade.
Figure 3:
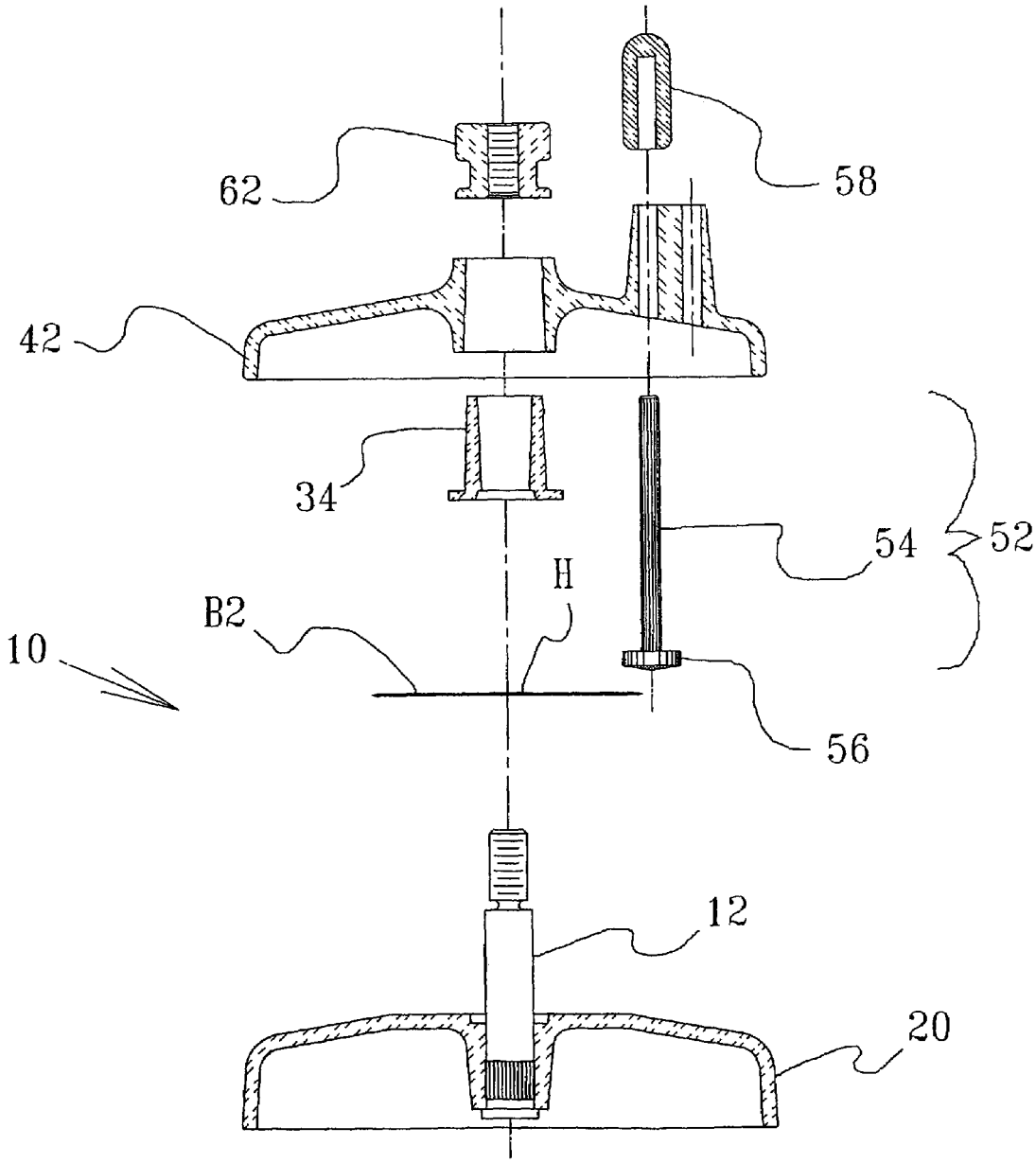
FIG. 3 shows an exploded drawing of the device components in cross section showing the assembly position of the diamond abrasive element and knob for sharpening the 45 mm rotary cutter blade.
Figure 4:
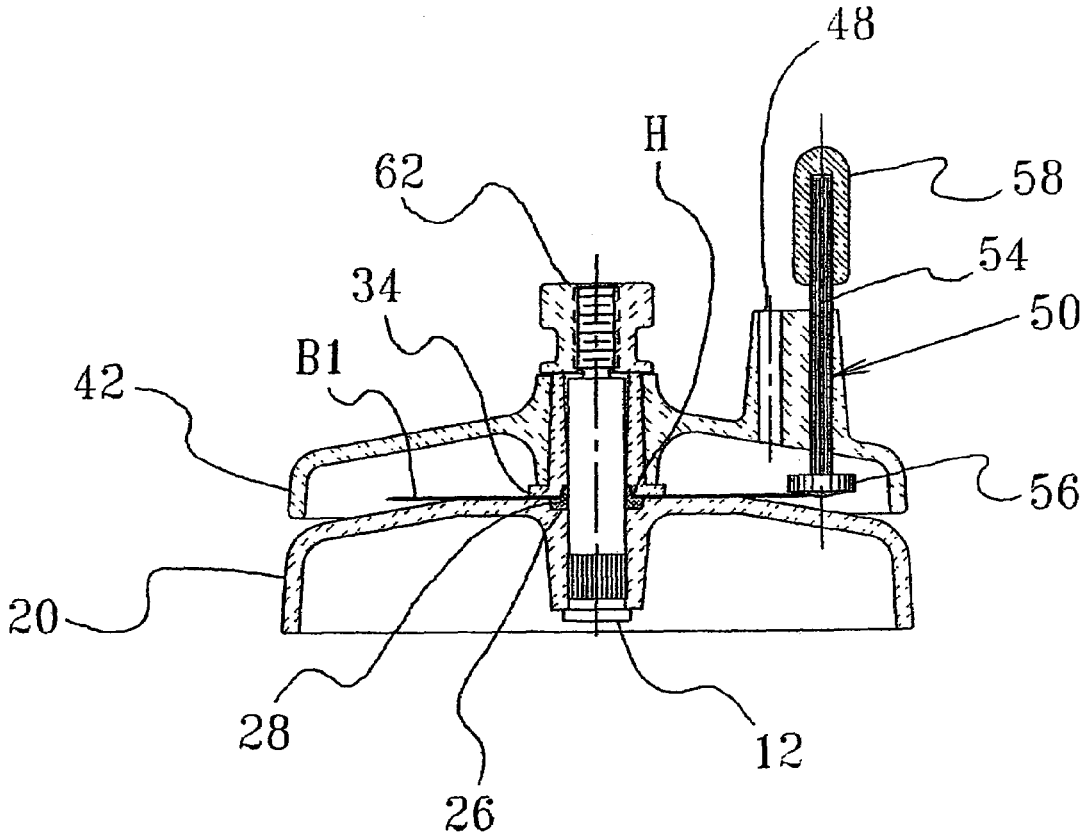
FIG. 4 shows a side view showing the device assembly components in cross section with the 60 mm rotary cutter blade installed and the diamond coated abrasive element in contact with the blade
Figure 5:
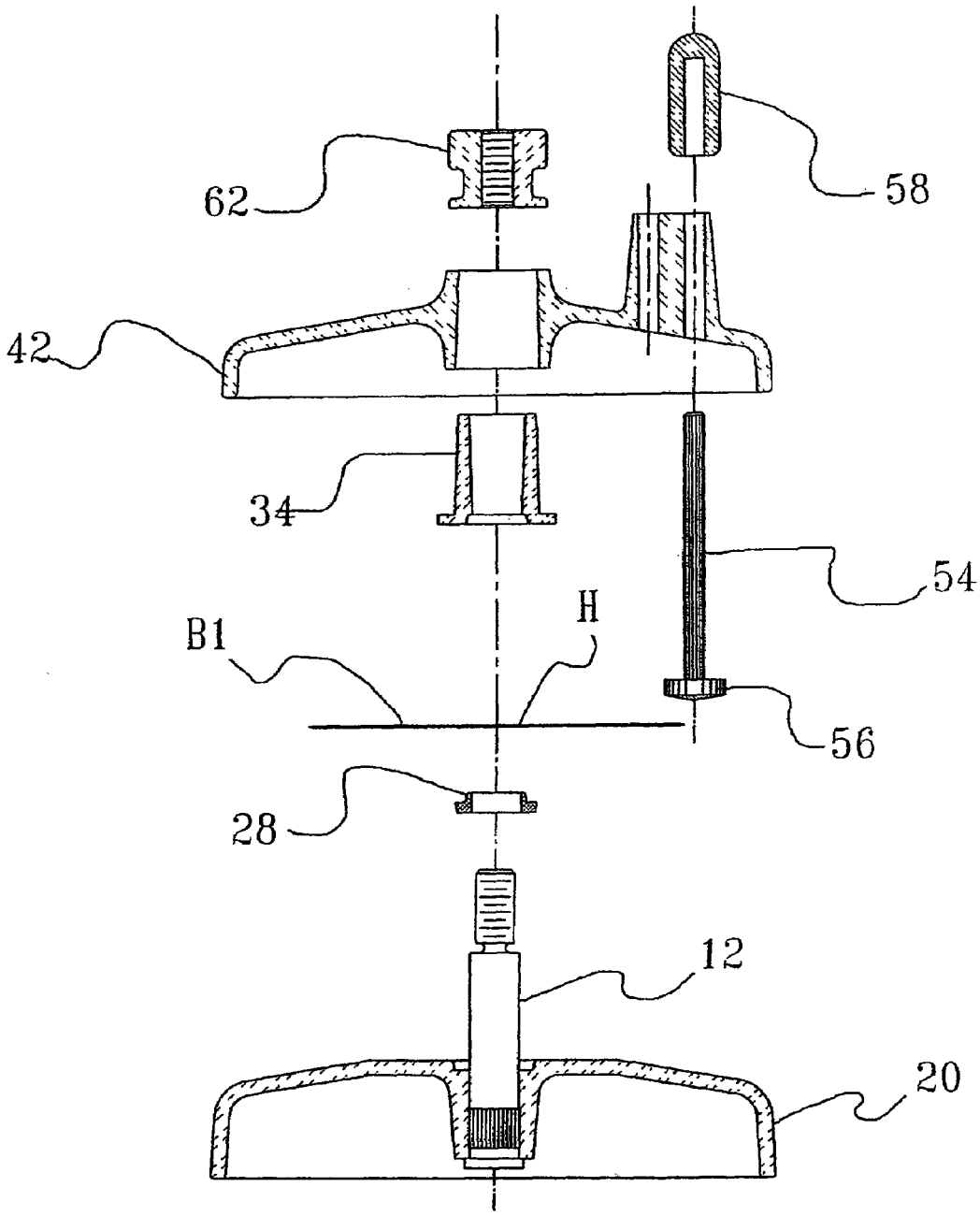
FIG. 5 shows an exploded drawing of the device components in cross section showing the assembly position of the diamond abrasive element and knob for sharpening the 60 mm rotary cutter blade.
Figure 8A:
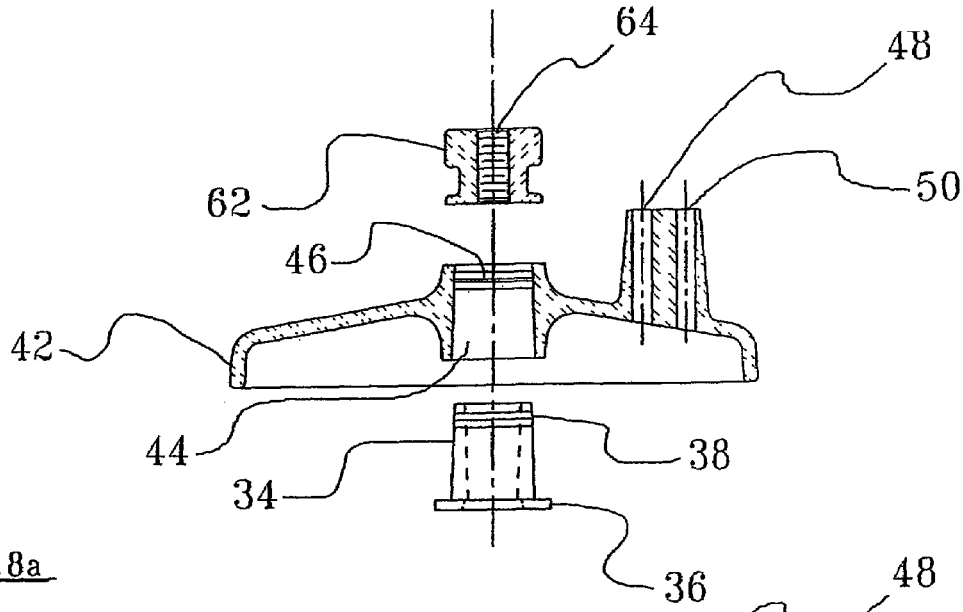
FIGS. 8*a* and 8*b* show cross sectional views of the orbital sharpener top, showing an exploded view and assembly drawing of the top, shaft bearing, and ribbed tightening knob, relationships.
Figure 8B:
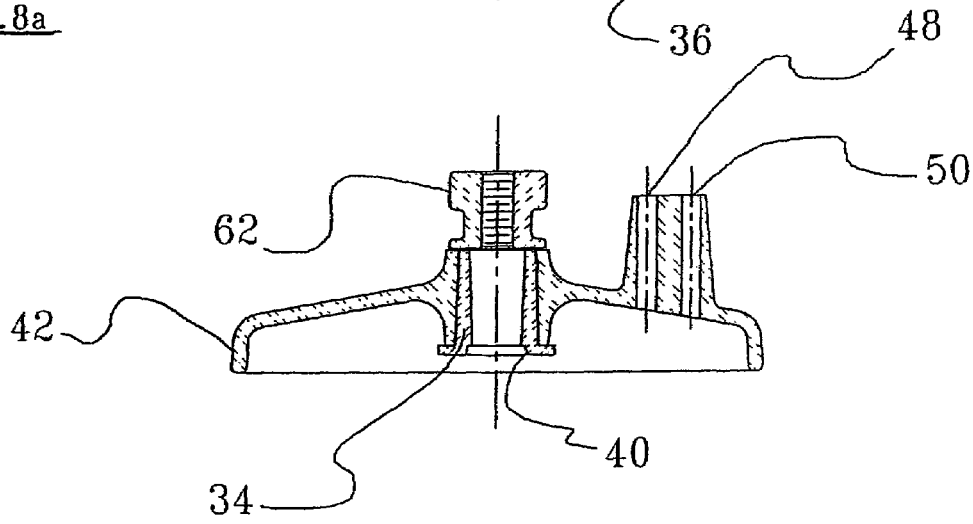
Figure 9:
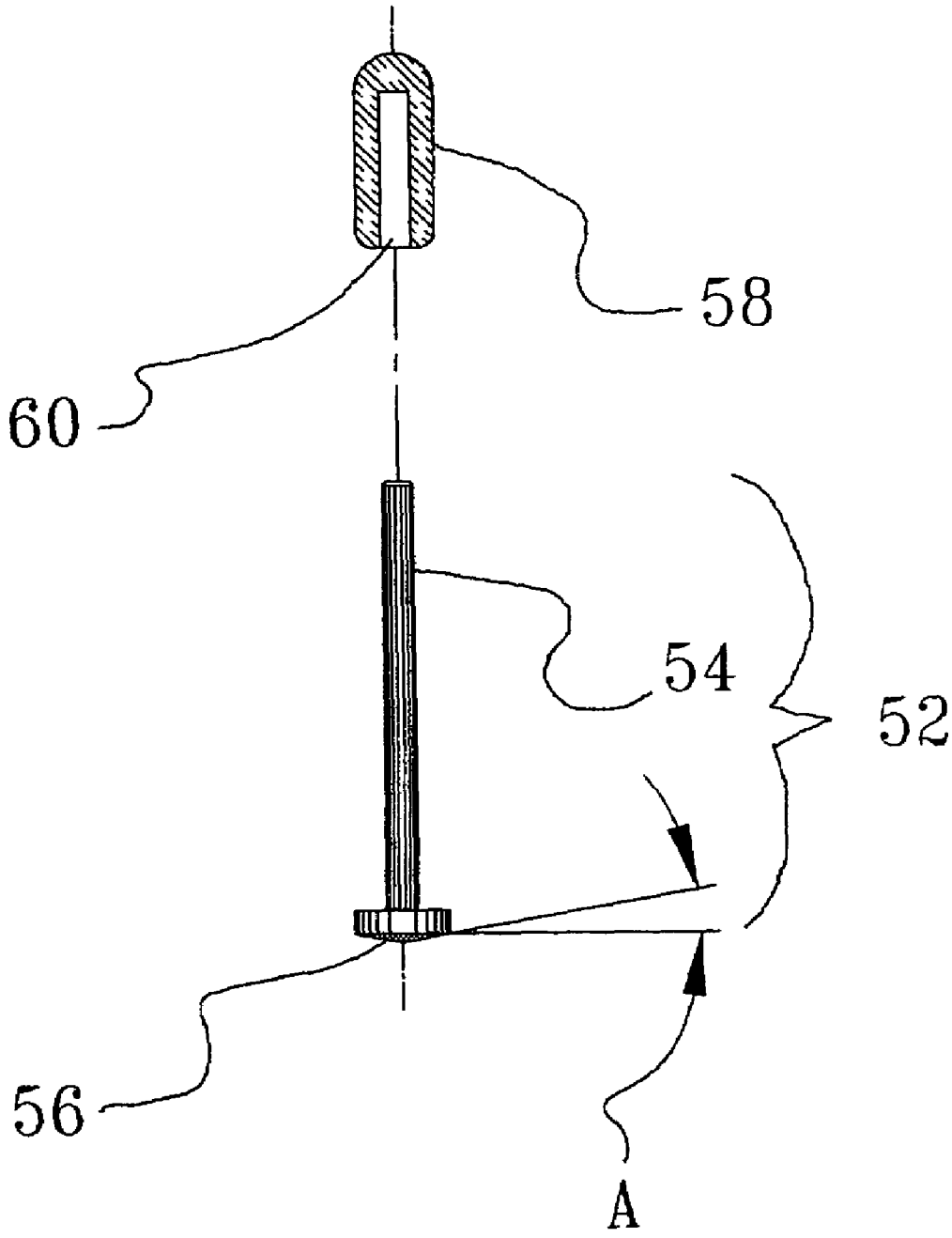
FIG. 9 is a drawing of the diamond coated abrasive element, abrasive presentation face, showing diamond coating location and a cross sectional view of the abrasive element shaft knob.

In an embodiment of the present invention a device for sharpening various size rotary cutter blades includes as shown in FIGS. 3 and 5 an orbital sharpener base 20 having a precision fit for and creating a perpendicular alignment of center shaft 12 with the bottom surface of said base 20, to position said center shaft 12 as to be available for insertion into the orbital sharpener top 42 see FIGS. 8*a* and 8*b*, having installed the shaft bearing 34 abrasive element 52 see FIG. 9 with abrasive element knob 58 ribbed tightening knob 62 see FIGS. 2, 3, 4, 5 and 8*a, b*, herein, as shown in assembly of FIGS. 2, 4 and 8*a, b* that when aligned in a precision embodiment and using the key element of orbital movement of a precision diamond coated abrasive element, or possibly a rotating abrasive element in a more complex form, around the periphery of the stationary positioned, rotary cutter blade's cutting edge, or the object to be sharpened, will with fewer components, state of the art materials and a simpler design, create a precision device and method of use that is an improvement over prior art heretofore used to accomplish this task.

Figure 6:
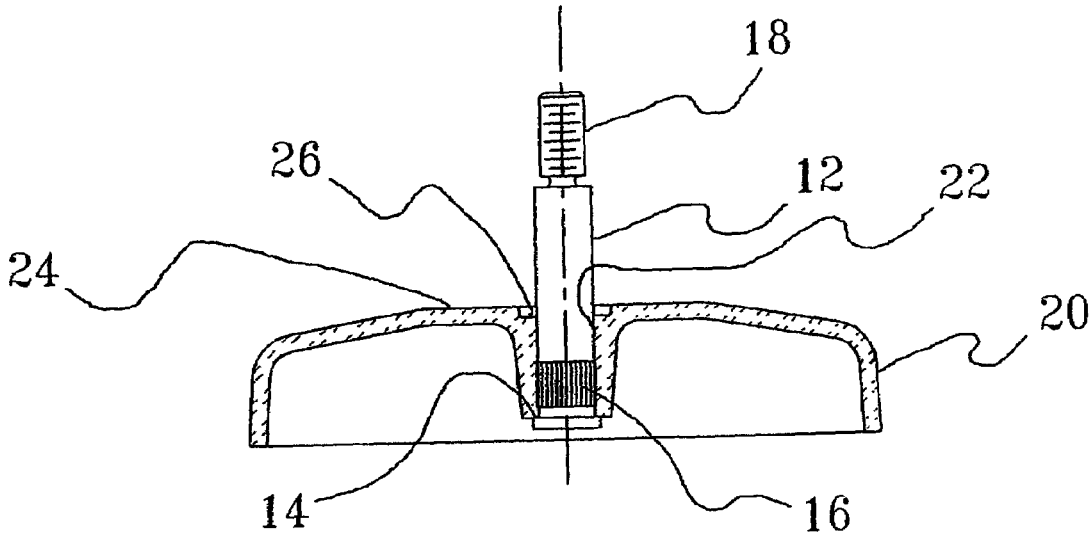
FIG. 6 shows a cross sectional view of the orbital sharpener base, blade platform, and center shaft.
Figure 7:
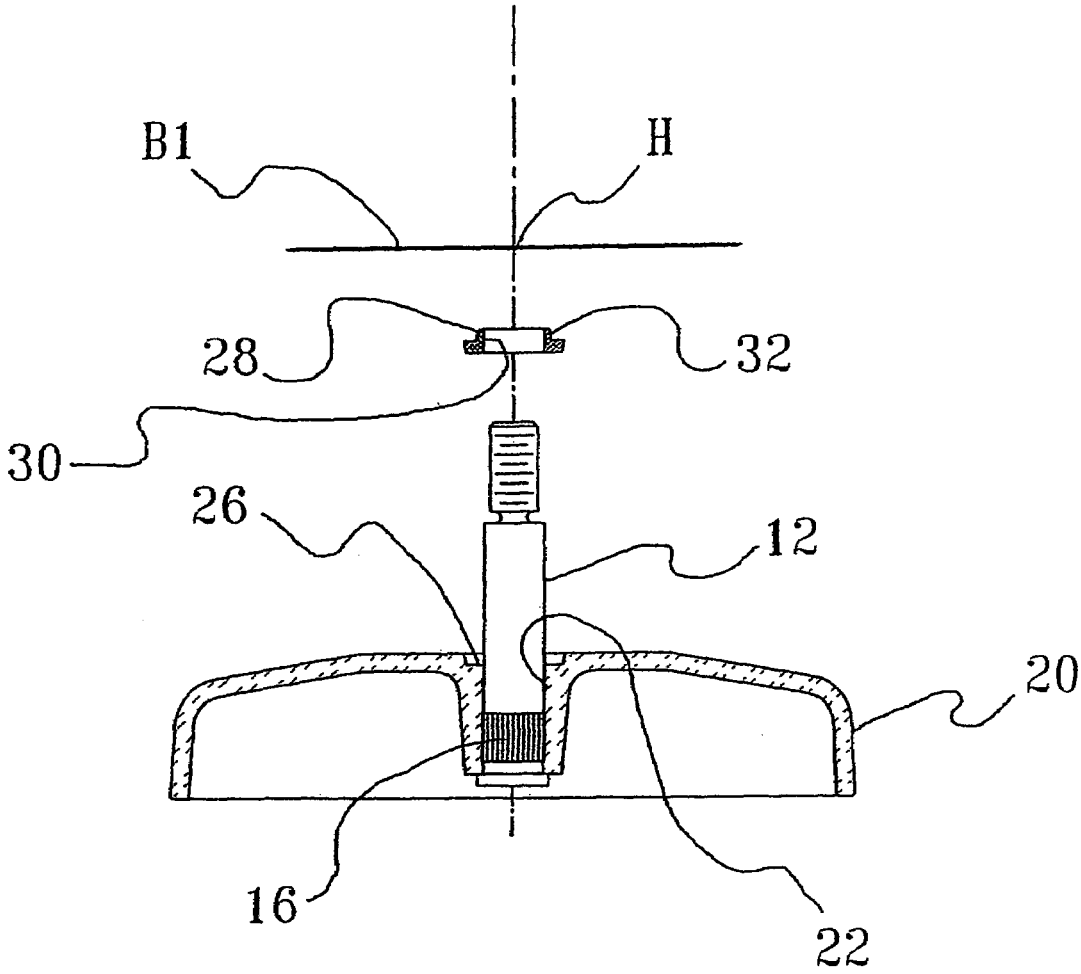
FIG. 7 is a cross sectional view of the orbital sharpener base with installed center shaft and also showing precision alignment bushing for the 60 mm rotary cutter blade shown above.

As seen in FIGS. 8*a*, 8*b* and 4, an orbital sharpener top comprises a race surface 44 adjacent to the blade clamp bushing snap fit recess 46, a receptacle housing 48 for receiving an abrasive element shaft in a position to sharpen a 45 mm blade, a receptacle housing 50 for receiving an abrasive element shaft in a position to sharpen a 60 mm blade. The orbital sharpener additionally comprising a shaft bearing 34 having a snap fit ring 38 a blade clamping flange 36, and a 60 mm blade alignment bushing nest 40, a ribbed tightening knob 62 having threads 64. FIG. 9 shows an abrasive element 52 with grinder 56 and shaft 54 portions and, an abrasive element knob 58 having a knob shaft recess 60. As shown in FIGS. 6 and 7 an orbital sharpener base 20 having a blade support platform 24 and 60 mm alignment bushing nest 26, and center shaft socket 22, a 60 mm blade alignment bushing 28 with tapered blade alignment surface 32, and an inside diameter 30, and a center shaft 12 having threads 18 a retaining flange 14, and a knurled shaft 16.

The orbital sharpener top 42 as seen in FIG. 8*a* and 8*b*, is preferably constructed from a suitable injection molding plastic material that is molded in a suitably constructed plastic injection mold for use in the plastic injection molding process. The orbital sharpener top 42 has a main body having an integral precision bushing race surface 44, that encompasses the bushing snap fit recess 46 being so dimensioned as to create a snap fit, having proper clearance with the snap fit ring 38 of blade clamp bushing 34 that enjoys a precision alignment and rotational relationship creating a free running fit between their surfaces for easy rotation. Additionally, the orbital sharpener top main body includes the integrally molded 45 mm blade position abrasive element shaft, receptacle housing 48, and 60 mm blade position abrasive element shaft, receptacle housing 50 being so dimensioned and located within the orbital sharpener top molding 42 as to create the correct alignment of the abrasive element 52, as seen in FIGS. 2 and 4, for it's orbital sharpening path around the rotary cutter blade's cutting edge, and enjoys a precision alignment and rotating relationship creating a free running fit between their surfaces for easy axial rotation and linear sliding movement of the abrasive element's shaft 54 as seen in FIG. 9.

The shaft bearing 34, as seen in FIG. 8*a, b* is constructed from a suitable injection molding plastic material that is molded in a suitably constructed plastic injection mold for use in the plastic injection molding process. The shaft bearing 34 has an inner surface of a specific diameter for a free, sliding fit with the center shaft 12 as seen in FIGS. 3 and 5, including the 60 mm blade alignment bushing nest 40 for a sliding, precision fit with alignment bushing 28, as seen in FIG. 7, and an outer surface so dimensioned for a precision alignment and free running fit within the top molding's blade clamp bushing race surface 44, and properly dimensioned snap fit assembly between the shaft bearing's 34 snap fit ring 38 and top molding's 42 snap fit recess 46, integrally molded with the shaft bearing 34 is a blade clamping flange for interrelation with the rotary cutter blades B1 and B2, as seen in FIGS. 2 and 4, for the purpose of transmitting the clamping forces generated through the completed assembly of the base 20, center shaft 12, shaft bearing 34, and tightening knob 62 as shown in FIGS. 2 and 4 down upon the rotary cutter blade's top and bottom surfaces, thus holding it stationary and preventing the rotary blades rotational movement.

The tightening knob 62, as seen in FIG. 8*a, b* is constructed from a suitable injection molding plastic material that is molded in a suitably constructed plastic injection mold for use in the plastic injection molding process. The ribbed tightening knob 62 has an outer surface of a design and configuration as to make it easier for people of age, or medical problems, such as arthritic joints, restricting their manual gripping and twisting dexterity to apply the necessary force to tighten down the knob correctly, including a suitable base portion for clamping down and exerting force upon the top surface of the blade shaft bearing 34 the inside surface of the ribbed tightening knob having a specific inside diameter to accept the female threads 64 for assembly with the center shaft's 12, male threads 18 as shown in FIG. 6.

An abrasive element 52, as shown in FIG. 9, is constructed from free machining metal material suitable for screw machining, or other manufacturing processes capable of producing this configuration in a economically efficient manner, and capable of receiving the application of abrasive coated material. Abrasive element 52 is provided with a grinder 56 and a shaft 54. The grinder 56 is sized in relation to the size of the blade to be sharpened and is preferably 0.375 inches in diameter. The grinder 56 may be conical to provide a presentation angle A, between 8 and 12 degrees, preferably 10 degrees, to create a similar angular relationship as that existing between the orbital sharpener top 42, see FIGS. 8*a, b* and the rotary cutter blade's B1 and B2 cutting edge as shown in FIGS. 2 and 4, and the grinder 56, precision presentation angle A, having applied to its surface a suitable abrasive coated material, that is engaged or rubbed against the rotary cutter blade's cutting edge surfaces to create a razor sharp cutting edge on a rotary cutter blade's cutting edge or the like object to be sharpened is this or like manner. In addition, the abrasive element 52 as seen in FIG. 9, contains a further element of an abrasive element shaft 54, whose diameter is scaled to form free running fit and angular position within the abrasive element shaft 54, receptacle housings 48 and 50, see FIGS. 8*a, b*, precisely located within said top portion molding 42, see FIGS. 8*a, b*.

The abrasive element knob 58 as seen in FIG. 9 is constructed from a suitable injection molding plastic material that is molded in a suitably constructed plastic injection mold for use in the plastic injection molding process. The abrasive element knob molding 58, having a suitable design shape, size dimensions and structure to facilitate easy gripping and holding with the fingers and to facilitate ease of use and operation of the present invention by people of age, or medical problems, such as arthritic joints, restricting their manual gripping and twisting dexterity. In addition, centrally located, in the base portion of said abrasive element knob 58 is the suitably dimensioned abrasive element shaft recess 60 of a depth, and fit, to facilitate an easy, retaining, slip fit, over the abrasive element shaft 54.

The orbital sharpener base 20, as seen in FIG. 6 is constructed from a suitable injection molding plastic material that is molded in a suitably constructed plastic injection mold for use in the plastic injection molding process. The orbital sharpener base 20 molding having a flat surface, holding and gripping in the hand, and operation of the present invention. Integral with, affixed to, and molded into or otherwise created on the devise base 20 is a precision, centrally located, center shaft socket 22, being so dimensioned as to create a press fit with the center shaft 12, thus creating a perpendicular alignment of said shaft with the bottom surface of said base 20. Also, included integral with, affixed to, and molded into or otherwise created on the devise base 20 is a suitably dimensioned and located blade support platform surface for the purpose of vertical alignment and rotary cutter blade cutting edge support during the sharpening process, and the 60 mm precision, alignment bushing nest 26 for the purpose of receiving and precision location therein, of the suitably shaped and dimensioned 60 mm blade alignment bushing 28 shown in FIG. 7.

As shown in FIG. 7, the 60 mm blade alignment bushing 28 is constructed from a suitable injection molding plastic material that is molded in a suitably constructed plastic injection mold for use in the plastic injection molding process. The device 60 mm blade alignment bushing 28 consists of the outside surface having a suitable shape and height to facilitate construction of a tapered rotary cutter blade center hole alignment surface 32 that enjoys a concentric relationship with the inside diameter 30 of a specific dimension as to create a slip fit no shake precision fit with center shaft 12 while having the matching radial shape and dimensioned to correctly align its lower tapered surface in a precision manner within the base 20, alignment bushing nest 26 to create the symbiotic concentric relationship between the base 20 and rotary blade center hole H (see FIGS. 3 and 5).

The center shaft 12 as seen in FIG. 6 is constructed from free machining metal material suitable for screw machining, or other manufacturing processes capable of producing this configuration in an economically efficient manner. The center shaft 12 having an outer surface of a specific length and diameter for a free sliding fit with the shaft bearing 34, see FIG. 8*a, b*, including the alignment bushing 28 see FIG. 7, and having at its base portion a set of precision knurl elements 16, see FIG. 6 for engagement with the inside walls of the base 20, center shaft socket walls 22 see FIG. 6 to prevent rotation therein. Also included is the center shaft retaining flange element 14, FIG. 6 to provide a precision insertion depth location and resistance to the clamping forces generated therein by the tightening knob 62 as shown in assembly FIGS. 2 and 4. The top most portion of the center shaft 12, includes a male threaded element 18 see FIG. 6 for the purpose of interrelating, and threaded assembly with, the tightening knob female threads 64 of tightening knob 62 see FIGS. 8*a, b*, in order to generate and transmit the required clamping forces through the completed assembly of the base 20, center shaft 12, shaft bearing 34, and tightening knob 62 as shown in FIGS. 2 and 4 down upon the rotary cutter blade's top and bottom surfaces to hold them stationary and prevent their movement during the sharpening operation.

When the components are assembled, the upper component brings the diamond coated abrasive element down and in to contact with the rotary blades cutting edge being held stationary by the clamping forces of the assembled device and against the lower components blade support platform. A 360 degree rotation movement of the upper component creates a orbital movement of the diamond coated abrasive element while bringing it into contact with the blade edge causing the abrasive element to abrade the cutting edge, sharpening it.

An orbital rotary blade sharpener sharpens the cutting edge of a rotary cutter blade, and includes a base portion having a blade support platform and centrally located vertical and threaded shaft, onto which to place a rotary cutter blade, this includes an alignment bushing and nest to centrally locate different sizes of rotary blades in the center of the blade support platform, when the upper component and its elements is brought down into place to restrain the blade by being held in place when the tightening knob is screwed into place on top of the center shaft threaded portion, it brings the diamond coated abrasive element down and in to contact with the rotary blades cutting edge being held stationary by the clamping forces of the assembled device and against the lower components blade support platform. A 360 degree rotation movement of the upper component creates a orbital movement of the diamond coated abrasive element while bringing it into contact with the blade edge causing the abrasive element to abrade the cutting edge, thereby removing nicks and burrs from the cutting edge and sharpening the rotary cutting blade.

Figure 1:
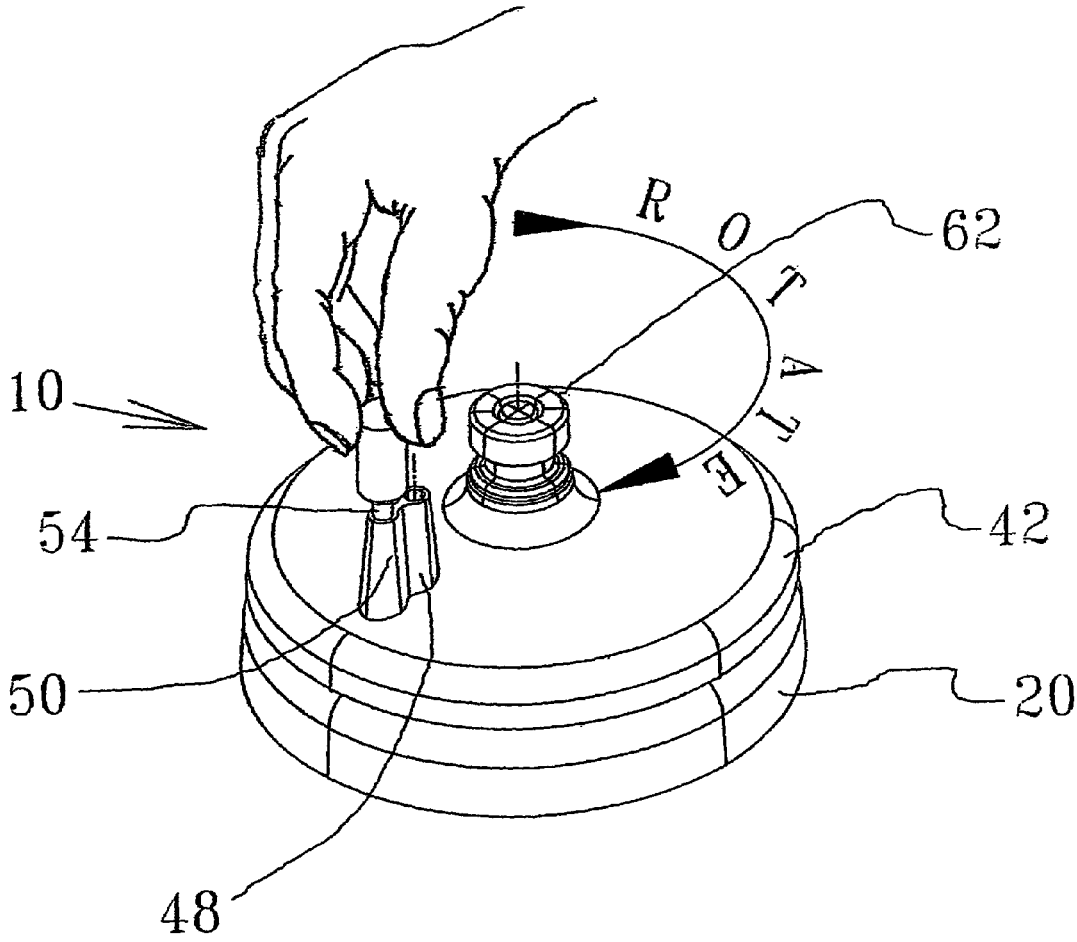
FIG. 1 shows a perspective view showing the use of the device.

FIG. 1 shows in its simplest form, the present invention in use, after the 60 mm rotary cutter blade and sharpening element have been placed into the correct sharpening operation position, as shown in FIG. 4. FIG. 1 shows the device setting on a flat surface while the operator holds the base of the device from rotating with one hand, and grips the device's abrasive element knob with the thumb and fingers of the other hand. The user rotates the abrasive element knob, and device top assembly, while applying slight downward pressure to the knob, in either a clock, or counter-clock wise direction which causes the abrasive element, precisely located within the orbital rotary cutter blade sharpener's top assembly, to move in a planetary type orbit around the stationary clamped rotary cutter blade while in contact with the rotary cutter blade's cutting edge, abrading this surface to remove nicks, then polishes to remove burrs thus producing a razor sharp rotary cutter blade cutting edge.

In preparation for use, the operator selects the abrasive element 52 to remove burrs and polish the blade to a razor sharpness. Abrasive element preferably is coated with a diamond abrasive coating. Those skilled in the art know that a diamond abrasive coating can be fine or rough in gradations. Then, with the orbital sharpener top removed, slides the diamond coated abrasive element's shaft 54 up into the orbital sharpener's top, 45 mm blade position, abrasive element shaft, receptacle housing 48, see FIGS. 8*a, b*, or the orbital sharpener's top, 60 mm blade position, abrasive element shaft, receptacle housing 50, see FIGS. 8*a, b*, to place the diamond coated abrasive element in the correct position to sharpen the selected rotary cutter blade diameter. The operator then presses the abrasive element's knob 58, shaft recess 60, see FIG. 9 over the abrasive element's shaft 54, see FIG. 9 and slides it down until the end of shaft 54 comes into contact with the bottom of the abrasive element's knob 58, shaft recess 60, see FIG. 9. The operator then selects a rotary cutter blade of a specific size for example 45 mm B2, or 60 mm diameter B1, to be sharpened, and it is placed in position above the center shaft 12, with the rotary cutter blade center hole H, aligned with the center shaft 12, and then slid down the center shaft 12, until the rotary blade lays flat on the blade support platform 24, see FIG. 6 of the orbital sharpener base 20, as shown in FIGS. 2 and 4. The 60 mm size rotary cutter blade can use a 60 mm blade alignment bushing 28, see FIG. 5 placed in position above the center shaft 12, with the blade alignment bushing 28 center hole, aligned with the center shaft 12, and then slid down the center shaft 12 until it rests in the 60 mm alignment bushing nest 26, see FIG. 6, and is flush with the top support surface of the orbital sharpener base 20, as shown in FIG. 4, the 60 mm rotary blade is now placed in position as described earlier in this text. The orbital sharpener top 42, see FIGS. 8*a* and 8*b* having installed therein the shaft bearing 34, see FIGS. 8*a* and 8*b* selected diamond abrasive element 52 with diamond abrasive element knob 58 see FIG. 9, is now slid over center shaft 12 as shown in FIGS. 2, 3, 4 and 5 so that the shaft bearing 34, see FIGS. 8*a* and 8*b* comes in contact with the upper surface of the 45 mm or 60 mm rotary cutter blades B1 or B2 as shown in FIGS. 2 and 4. The ribbed tightening knob 62 see FIGS. 2, 3, 4, 5 8*a* and 8*b*, is now placed on the center shaft threads 18 of center shaft 12 see FIG. 6, and rotated clockwise down the threads until it comes in contact with the top surface of the shaft bearing 34 see FIGS. 8*a* and 8*b* as shown in assembly FIGS. 2, 4 and 8*a,b*.

Figure 11:
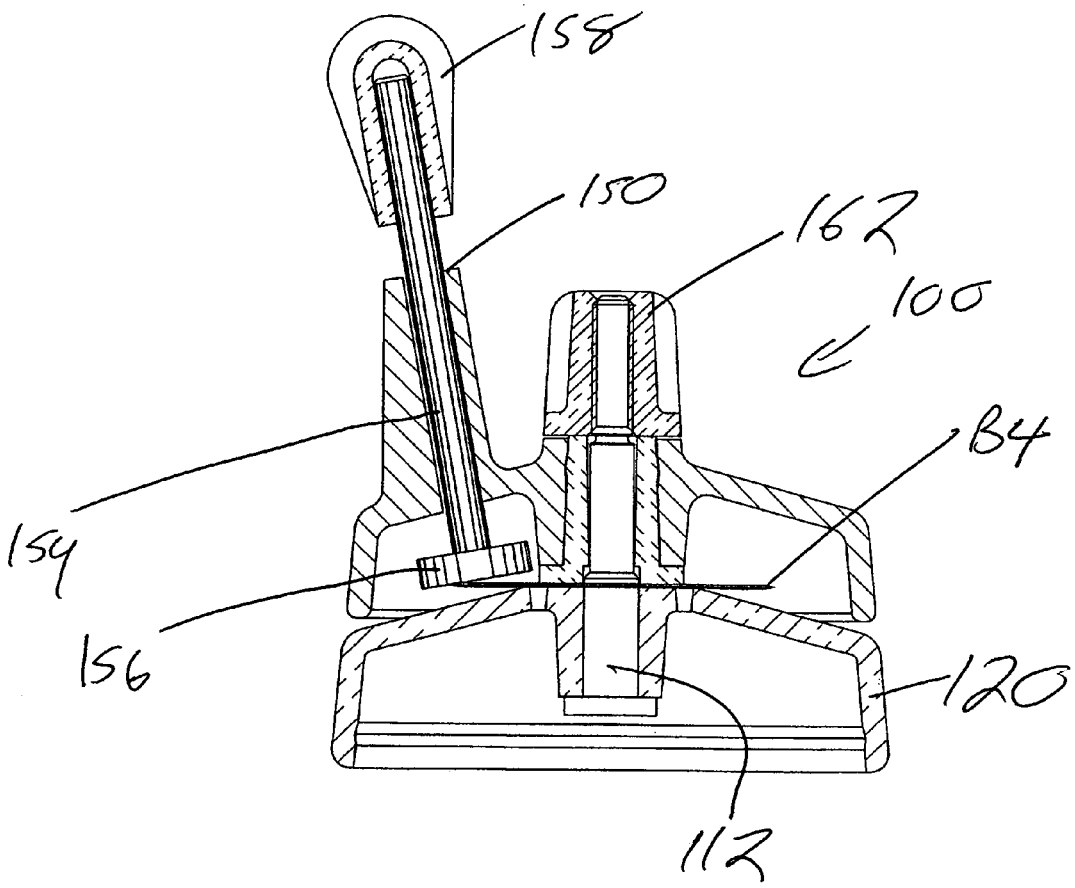
FIG. 11 shows the embodiment of FIG. 10 in position for sharpening a 28 mm rotary blade.

In use, to sharpen the rotary blade, the operator places the orbital rotary blade sharpener assembly as shown in FIGS. 2 and 4 having installed either the 45 mm or 60 mm rotary cutter blades B1 or B2 see FIGS. 3 and 5 along with the abrasive element 52 see FIG. 9 then, either holds the device in the palm of one hand, or places the device on a flat surface while preventing the orbital rotary blade sharpener's base 20, see FIGS. 2 and 4, from rotating and grips the device's diamond abrasive element knob 58 see FIG. 11 with the thumb and fingers of the other hand. The operator then rotates the diamond abrasive element knob 58, and orbital sharpener's top assembly, while applying slight downward pressure to the knob 58, in either a clock, or counter-clock wise direction as shown in FIG. 1 until all nicks have been removed from the rotary cutter blade's cutting edge, or the cutting edge has been de-burred and polished. The rotary blade B1 or B2 is turned over and the same process applied to the opposite side. cutter blade's cutting edge, or the cutting edge has been de-burred and polished. The rotary blade B1 or B2 is turned over and the same process applied to the opposite side.

Figure 10:
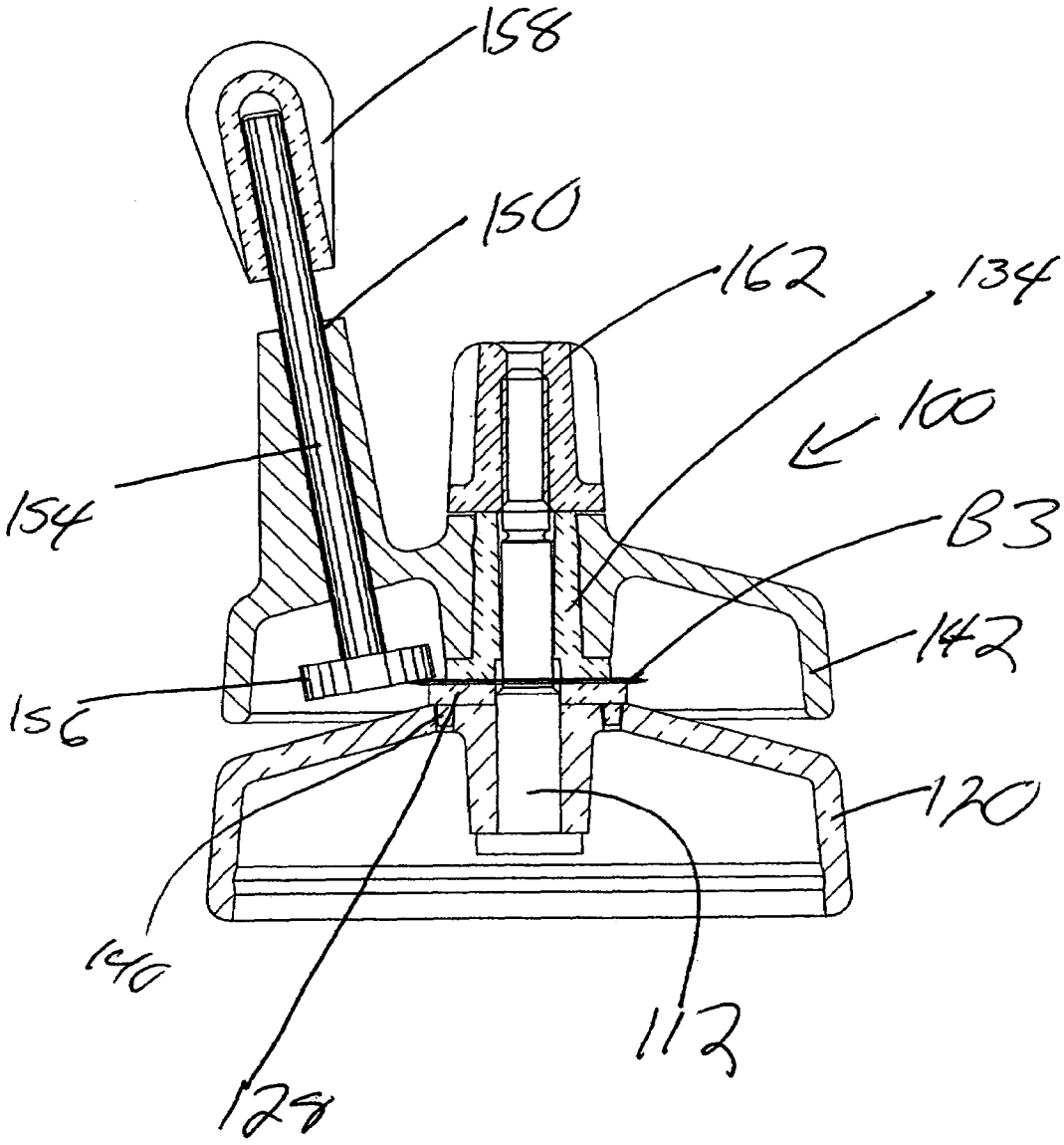
FIG. 10 shows another embodiment of the present invention in position for sharpening an 18 mm rotary blade.

FIGS. 10 and 11 show another embodiment of orbital rotary blade sharpener 100 for sharpening rotary cutter blades and similar rotary blades, and includes a bottom blade holding portion 120 having a center and perimeter edge, a top blade holding portion 142 rotably connectable to said bottom blade holding portion 120, having a perimeter and a center, a central shaft 112 extending from said bottom blade holding portion through said top blade holding portion over which a rotary blade can be fitted, a shaft bushing 134 extending through said top blade holding portion positioned between the perimeter and the center of the top blade holding portion, and a grinder 156 and radial shaft 154 in a receptacle housing 150 within said top blade portion positioned to be orbitally revolvable around said bottom blade holding portion center and contactable with a blade held between said top and bottom blade holding portions. The central 112 can be capped with a tightening knob 162.

In this embodiment, a single receptacle housing 150 is provided and oriented for the radial shaft 154 to extend toward the blade presenting the grinder 156 at a sharpening angle to the blade. The sharpener 100 adapts to different sized blades by raising or lowering the radial shaft 154 and grinder 156 and raising or lowering the blade using a bushing 128, which can fit within a bushing nest 140.

The orientation of the receptacle housing 150, and radial shaft 154 preferably present the grinder 156 at a presentation angle of between 8 and 12 degrees, preferably 10 degrees, in relation to the blade. The grinder 156 preferably has applied to its surface a suitable abrasive coated material, that is engaged or rubbed against the rotary cutter blade's cutting edge surfaces to create a razor sharp cutting edge on a rotary cutter blade's cutting edge or the like object to be sharpened is this or like manner. Radial shaft 154 has a diameter scaled to form free running fit and angular position within the receptacle housing 150 precisely located within said top portion molding 142. The radial shaft 154 can be provided with a knob 158 as seen in FIGS. 10, 11.

Figure 12:
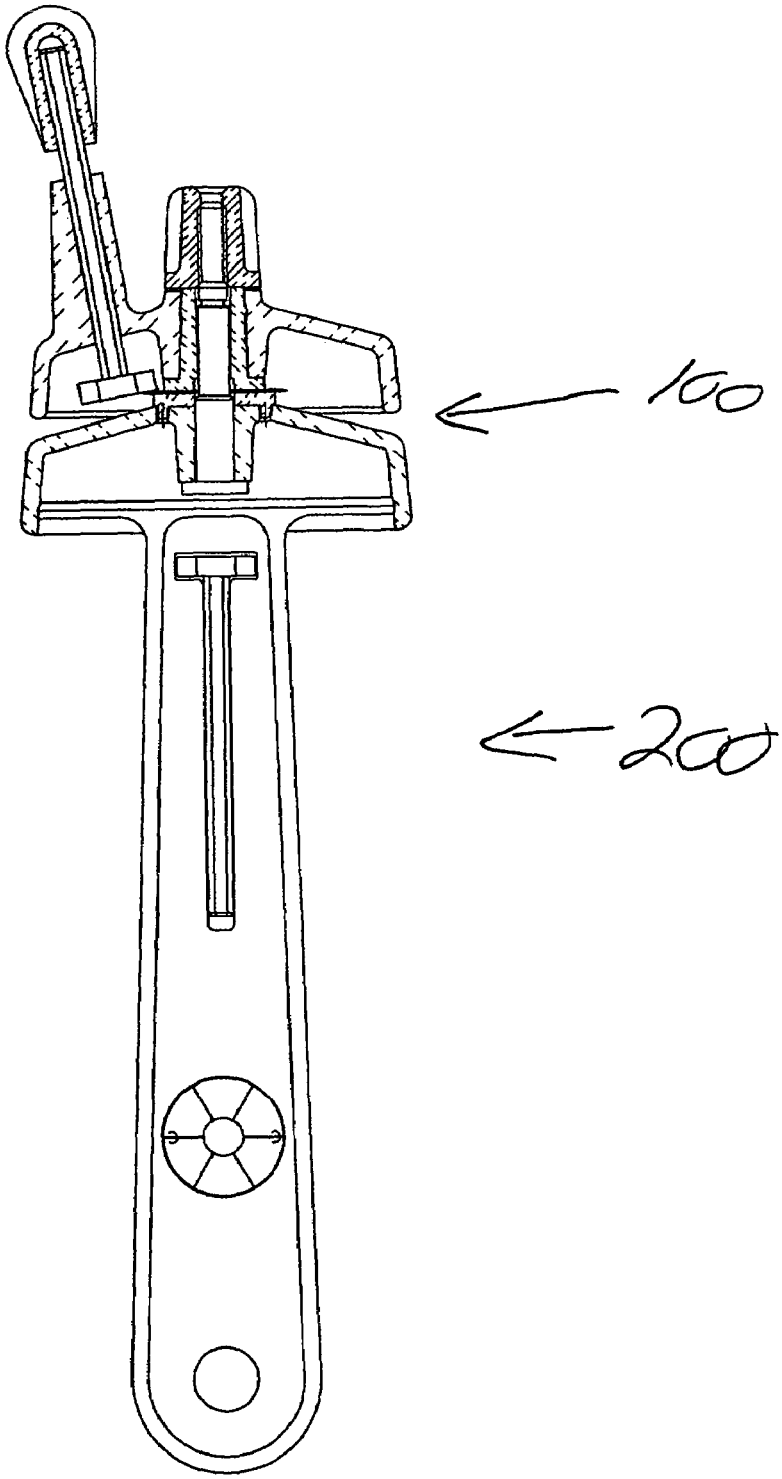
FIG. 12 shows another embodiment of the present invention.

FIG. 10 shows an 18 mm blade B3 positioned atop an alignment bushing 128 which is aligned by the bushing next 140. The alignment bushing 128 has a concentric relationship to create a slip fit no shake precision fit with center shaft 112 while having the matching radial shape and dimensioned to correctly align the blade B3 for presentation to the grinder 156. FIG. 11 shows a 28 mm blade B4 resting on the bottom portion 120 with no alignment bushing 128. FIG. 12 is another view of the present invention presenting the features of the embodiment 100 in FIGS. 10 and 11 in a handle 200 format.

From all of the above the reader will see that the present invention is a unique engineering design and methodology of a device for the sharpening of circular rotary cutter blades of various sizes and the like, and represents a significant improvement over heretofore reviewed prior art.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. An orbital rotary blade sharpener, comprising:

a bottom blade holding portion having a center and a perimeter edge;

a top blade holding portion rotatably connectable to said bottom blade holding portion, having a perimeter and a center;

a central shaft portion extending from said bottom blade holding portion through said top blade holding portion over which a rotary blade can be fitted;

a radial shaft portion extending through said top blade holding portion positioned between the perimeter and the center of the top blade holding portion; and a grinding portion connected to said radial shaft portion, and within said top blade holding portion, positioned to be orbitally revolvable around said bottom blade holding portion center and contactable with a blade held between said top and bottom blade holding portions.

2. The sharpener of claim 1, wherein said grinding portion contacts a blade at an angle from the horizontal plane of said blade between 8 and 12 degrees.

3. The sharpener of claim 1, wherein said grinding portion is coated with a diamond abrasive coating.

4. The sharpener of claim 3, wherein the diamond abrasive coating is selected from fine diamond abrasive coating and rough diamond abrasive coating.

5. The sharpener of claims 1, 2, 3, or 4, wherein said central shaft portion is sized to fit through the center aperture of a 45 mm rotary blade.

6. The sharpener of claims 1, 2, 3, or 4, wherein said central shaft portion is sized to fit through the center aperture of a 60 mm rotary blade.

7. An orbital rotary blade sharpener, comprising:

a base;

a central shaft extending from said base center;

a cylindrical bearing through which said central shaft inserts and in which said central shaft is freely rotatable along the axis of said central shaft;

a top with a central aperture into which said bearing inserts and through which said central shaft inserts;

a grinder shaft housing connected to said top offset from said central aperture of said top wherein said housing is provided with a hollow cylinder;

a cylindrical grinder shaft insertable through said housing hollow cylinder such that said shaft freely rotates along the axis in said hollow cylinder, having a grinder end which revolves around said base below said top, and an engagement end; and a tightening knob threadably attachable to said central shaft.

8. The sharpener of claim 7, wherein said grinding end contacts a blade at an angle from the horizontal plane of said blade between 8 and 12 degrees.

9. The sharpener of claim 7, wherein said grinding end is coated with a diamond abrasive coating.

10. The sharpener of claim 9, wherein the diamond abrasive coating is selected from fine diamond abrasive coating and rough diamond abrasive coating.

11. The sharpener of claims 7, 8, 9 or 10, wherein said central shaft is sized to fit through the center aperture of a 45 mm rotary blade.

12. The sharpener of claims 7, 8, 9 or 10, wherein said central shaft is sized to fit through the center aperture of a 60 mm rotary blade.

13. A method of sharpening a rotary blade, comprising steps of:

Inserting a central shaft having a base through a rotary blade;

Engaging the edge of said rotary blade with a grinder having a grinder shaft;

Inserting said central shaft through a bushing and into a central aperture in a top;

Inserting said grinder shaft through a grinder shaft housing offset from the central aperture of said top;

Tightening a top knob onto an end of said central shaft;

Connecting a grinder knob to the distal end of said grinder shaft from said grinder; and Holding said grinder knob, revolving said grinder around said base, sharpening said blade.

* * * * *